US008014918B2

(12) United States Patent
Adachi

(10) Patent No.: US 8,014,918 B2
(45) Date of Patent: Sep. 6, 2011

(54) VEHICULAR DRIVE ASSIST SYSTEM AND VEHICULAR DRIVE ASSIST METHOD

(75) Inventor: Akito Adachi, Aichi-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 802 days.

(21) Appl. No.: 12/084,116

(22) PCT Filed: Oct. 17, 2006

(86) PCT No.: PCT/IB2006/002897
§ 371 (c)(1),
(2), (4) Date: Apr. 25, 2008

(87) PCT Pub. No.: WO2007/049110
PCT Pub. Date: May 3, 2007

(65) Prior Publication Data

US 2009/0082917 A1 Mar. 26, 2009

(30) Foreign Application Priority Data

Oct. 26, 2005 (JP) ..... 2005-311237
Apr. 18, 2006 (JP) ..... 2006-114841

(51) Int. Cl.
*G08G 1/01* (2006.01)

(52) U.S. Cl. ..... 701/33; 701/35; 701/208

(58) Field of Classification Search ..... 701/29–36, 701/200, 207, 208, 213
See application file for complete search history.

(56) References Cited

U.S. PATENT DOCUMENTS

| | | | | |
|---|---|---|---|---|
| 7,373,243 | B2 * | 5/2008 | Tengler et al. | 701/201 |
| 2002/0026278 | A1 | 2/2002 | Feldman | |
| 2002/0049527 | A1 | 4/2002 | Kohno et al. | |
| 2002/0128751 | A1 | 9/2002 | Engstrom | |

FOREIGN PATENT DOCUMENTS

| | | |
|---|---|---|
| DE | 101 36 342 | 3/2002 |
| EP | 0 755 039 | 1/1997 |
| JP | 10-82653 | 3/1998 |
| JP | 11-120488 A | 4/1999 |

(Continued)

OTHER PUBLICATIONS

Chinese Office Action dated Mar. 20, 2009.

(Continued)

*Primary Examiner* — Richard M. Camby
(74) *Attorney, Agent, or Firm* — Finnegan, Henderson, Farabow, Garrett & Dunner, LLP

(57) ABSTRACT

A vehicular drive assist system that analyzes information collected from a vehicle and sends a result of analysis to the vehicle and/or another vehicle, including a vehicle-mounted apparatus (101) mounted in the vehicle, and a communication center (102) that communicates with the vehicle-mounted apparatus (101). The vehicle-mounted apparatus (101) detects a present position of the host vehicle, detects a vehicular state of the host vehicle, and sends the present position and the vehicular state at the position detected to the communication center (102). The communication center (102) performs statistic processing of the vehicular state received, separately for each predetermined area on a road, by using the present position, calculates a tendency of the vehicular state separately for each predetermined area, evaluates ease of travel on the road in the predetermined area from the tendency calculated, and sends a result of evaluation to the vehicle and/or another vehicle.

21 Claims, 7 Drawing Sheets

FOREIGN PATENT DOCUMENTS

| | | | |
|---|---|---|---|
| JP | 2002-074585 | A | 3/2002 |
| JP | 2002-150468 | A | 5/2002 |
| JP | 2002-195840 | A | 7/2002 |
| JP | 2002-251698 | | 9/2002 |
| JP | 2003-279365 | | 10/2003 |
| JP | 2003-302229 | | 10/2003 |
| JP | 2003-308584 | A | 10/2003 |
| JP | 2005-004359 | | 1/2005 |
| JP | 2005-17052 | | 1/2005 |
| JP | 2005-106475 | A | 4/2005 |
| JP | 2005-135386 | A | 5/2005 |
| JP | 2005-150468 | | 6/2005 |
| JP | 2005-165378 | A | 6/2005 |
| JP | 2005-174282 | | 6/2005 |

OTHER PUBLICATIONS

Japanese Office Action dated Mar. 3, 2009.
International Search Report.
Written Opinion.

* cited by examiner

FIG. 3

| | EASY ← EASE OF TRAVEL → DIFFICULT<br>LOW ← NEED FOR ATTENTION → HIGH |
|---|---|
| BRAKE FREQUENCY | LOW ← → HIGH<br>(MANY OCCURRENCES OF RUNNING INTO ROAD, MANY INTERSECTIONS WITH NO TRAFFIC SIGNAL) |
| BRAKE PRESSURE CHANGES | SMALL OR LESS FREQUENT ← → GREAT OR FREQUENT<br>(BLOCKED VIEW, MANY OCCURRENCES OF RAPID BRAKING) |
| AVERAGE VEHICLE SPEED | HIGH ← → LOW<br>(MANY STOPS&GOES) |
| COURSE CHANGE (NUMBER OF TIMES OF OPERATING WINKER) | LESS FREQUENT ← → FREQUENT<br>(MANY ON-STREET PARKED VEHICLES, MANY VEHICLES TURNING RIGHT) |
| STEERING WHEEL OPERATING SPEED | SLOW ← → QUICK<br>(BLOCKED VIEW) |
| NUMBER OF TIMES OF OPERATING STEERING WHEEL | LESS FREQUENT ← → FREQUENT<br>(SERPENTINE ROAD) |
| NUMBER OF TIMES OF OPERATING FOG LAMP | LESS FREQUENT ← → FREQUENT<br>(MANY OCCURRENCES OF FOG) |
| ・<br>・<br>・ | |

VEHICULAR DRIVE ASSIST SYSTEM AND VEHICULAR DRIVE ASSIST METHOD

BACKGROUND OF THE INVENTION

1. Field of the Invention

The invention relates to a vehicular drive assist system that analyzes information collected from a vehicle and sends results of the analysis to the vehicle and/or another vehicle and, more particularly, to a vehicular drive assist system and a vehicular drive assist method that improve the vehicle running characteristics and the vehicle driver's feeling of safety.

2. Description of the Related Art

There is a known system that predicts traffic congestion situations on the basis of position information sent from vehicles to a communication center, and the like (e.g., see Japanese Patent Application Publication No. JP-A-2002-251698 and No. JP-A-2003-302229).

A navigation system that searches for a route while taking the ease of travel of roads into consideration is also known (e.g., see Japanese Patent Application Publication No. JP-A-2003-279365).

The aforementioned system that predicts traffic congestion situations is a system that grasps traffic congestion situations of roads from the collected position information and time information. However, the aforementioned system is not able to recognize the ease of travel of each road that will be experienced if the road is actually traveled by the vehicle.

In the aforementioned navigation system, a road with high running speeds is termed "high-speed road" that is easy to travel through, and it is judged whether or not a road is a high-speed road uniformly on the basis of road lengths between traffic signals, road lengths between intersections, whether or not the road is a separated inbound/outbound line road, whether the road is a single-path road with a center divider, the number of lanes of the road, or combinations thereof.

Parameters indicating physical road configurations as mentioned above can easily be acquired from the map information as well. However, it is impossible to judge the actual ease of travel of a road solely from such parameters. For example, a road with heavy on-street parking every day, an intersection with frequent incidents of vehicles stopping to turn right, a spot with many occurrences of a pedestrian running into the road, an intersection with a blocked view due to buildings or the like, a road with many bumps and dips, a road that often becomes icy on a winter morning, etc. Such needs for attention or ease of travel during the actual running of the vehicle cannot be sufficiently grasped unless the road is actually traveled through in the vehicle.

In other words, there is a risk that the aforementioned navigation system may determine that a road that actually cannot be said to be easy to travel through is an easy-to-travel road, apart from the actual circumstances. If such an incorrect result of determination is used for a vehicle control or a route search, adverse effect can be given to the vehicle running characteristics, or the driver can be made anxious.

SUMMARY OF THE INVENTION

It is a main object of the invention to provide a vehicular drive assist system and a vehicular drive assist method that improve the vehicle running characteristics and the vehicle driver's feeling of safety.

A first aspect of the invention relates to a vehicular drive assist system in which information collected from vehicles is analyzed and results of analysis are sent to vehicles. This vehicular drive assist system comprises a vehicle-mounted apparatus mounted in a host vehicle, and a communication center that communicates with the vehicle-mounted apparatus. The vehicle-mounted apparatus detects a present position of the host vehicle, detects a vehicular state of the host vehicle, and sends the present position and the vehicular state at the position detected to the communication center. The communication center performs statistic processing of the vehicular state received, separately for each predetermined area on a road, by using the present position, calculates a tendency of the vehicular state separately for each predetermined area, evaluates ease of travel on the road in the predetermined area from the tendency calculated, and sends a result of evaluation to the vehicle and/or another vehicle.

In the above-described vehicular drive assist system, the predetermined area may be a road itself or an intersection. For example, the predetermined area may be set as a region that is a predetermined distance before an intersection.

In the vehicular drive assist system, the communication center performs evaluation as follows. For example: 1) if the vehicular state is a frequency of brake pedal operation, the communication center may evaluate the predetermined area having a tendency toward a relatively low frequency of brake pedal operation as being easier to travel through than an area having a tendency toward a relatively high frequency of brake pedal operation; 2) if the vehicular state is a brake pressure change, the communication center may evaluate the predetermined area having a tendency toward a relatively less brake pressure change as being easier to travel through than an area having a tendency toward a relatively more brake pressure change; 3) if the vehicular state is an average vehicle speed, the communication center may evaluate the predetermined area having a tendency toward a relatively high average vehicle speed as being easier to travel through than an area having a tendency toward a relatively low average vehicle speed; 4) if the vehicular state is a number of times of operating a winker, the communication center may evaluate the predetermined area having a tendency toward a relatively small number of times of operating the winker as being easier to travel through than an area having a tendency toward a relatively large number of times of operating the winker; 5) if the vehicular state is a steering wheel operation speed, the communication center may evaluate the predetermined area having a tendency toward a relatively slow steering wheel operation speed as being easier to travel through than an area having a tendency toward a relatively quick steering wheel operation speed; and 6) if the vehicular state is a number of times of operating a steering wheel, the communication center may evaluate the predetermined area having a tendency toward a relatively small number of times of operating the steering wheel as being easier to travel through than an area having a tendency toward a relatively large number of times of operating the steering wheel.

Furthermore, in the vehicular drive assist system, 7) if the vehicular state is a vehicular speed change and the predetermined area is a region within a predetermined range past a stop line, the communication center may evaluate the predetermined area having a tendency toward a relatively high frequency of stops and accelerations being repeated a predetermined number of times within a predetermined time as being harder to travel through than an area having a tendency toward a relatively low frequency of stops and accelerations being repeated the predetermined number of times within the predetermined time, or 8) if the vehicular state is a vehicular speed change and the predetermined area is a merging lane, the communication center may evaluate the predetermined area having a tendency toward a relatively high frequency of rapid acceleration or rapid deceleration being performed as being harder to travel through than an area having a tendency toward a relatively low frequency of rapid acceleration and rapid deceleration being performed.

According to the above-described vehicular drive assist system, vehicular states of vehicles during running through a road can be collected from the vehicles that have actually run through the road. Therefore, from these vehicular states, the ease of travel on the road can be estimated more precisely with the actual situation than in the related art.

In addition, in the vehicular drive assist system, the vehicle having received the result of evaluation may use the result of evaluation for route search or a predetermined vehicle control. In the former case, for example, if a user selects an ease-of-travel priority route search, the vehicle having received the result of evaluation may search for a route that preferentially goes through the predetermined area evaluated as being relatively easy to travel through from the result of evaluation, and if the user selects a time priority route search, the vehicle may search for a route that preferentially goes through the predetermined area evaluated as being relatively hard to travel through from the result of evaluation. In the latter case, the vehicle having received the result of evaluation, for example, may call for attention of a host vehicle driver in front of the predetermined area evaluated as being relatively hard to travel through from the result of evaluation.

Besides, in the vehicular drive assist system, in addition to the present position and the vehicular state at the present position, the vehicle-mounted apparatus may send the date and hour and the clock time at the time point being at the present position to the communication center. The communication center, in addition to the statistic processing of the received vehicular states separately for geographical areas, may perform statistic processing separately for time factors, for example, the day of the week and/or the time periods of the day, through the use of the aforementioned date and hour and the clock time.

Besides, in the vehicular drive assist system, the vehicle-mounted apparatus may send, to the communication center, attributes of the host vehicle or of the host vehicle user (e.g., either a small-size vehicle or a large-size vehicle, an elderly driver or not, driving records, etc.), in addition to the present position and the vehicular state at the present position. The communication center may perform the statistic processing of the attributes in addition to the statistic processing of the received vehicular states separately for geographical areas, and may send the result of evaluation only to the vehicle-mounted apparatuses of the vehicle or the vehicle users whose attributes are concerned as a subject.

Furthermore, in the drive assist system, the communication center may perform the statistic processing of the received vehicular states separately for vehicles, and may determine the driving skill level of the driver of the vehicle and the driver's character tendency during driving.

A second aspect of the invention relates to a vehicular drive assist method. The vehicular drive assist method includes: receiving from a vehicle a vehicular state and a present position of the vehicle; performing statistic processing of the vehicular state received, separately for each predetermined area on a road, by using the present position of the vehicle; calculating a tendency of the vehicular state separately for each predetermined area; evaluating ease of travel on the road in the predetermined area from the tendency calculated; and sending a result of evaluation to the vehicle and/or another vehicle.

According to the invention, it is possible to provide a vehicular drive assist system and a vehicular drive assist method that improve the vehicle running characteristics and the vehicle driver's feeling of safety.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 3 is a diagram showing an example of a relationship between the vehicular state tendency and the evaluation of the ease of travel in the vehicular drive assist system in accordance with the embodiment of the invention;

DETAILED DESCRIPTION OF THE PREFERRED EMBODIMENTS

Embodiments of the invention will be described with reference to the accompanying drawings. Basic concepts of a system in which a plurality of vehicles upload their vehicular states to a communication center through the use of communications, and its main hardware construction as well as its operation principles, basic control techniques, etc., are known to those with ordinary skill in the art, and detailed descriptions thereof will be omitted herein.

A vehicular drive assist system in accordance with an embodiment of the invention will be described hereinafter with reference to FIGS. 1 to 7.

Firstly, with reference to FIG. 1, an overall construction of a vehicular drive assist system 100 in accordance with the embodiment will be described.

The vehicular operation assist system 100 in accordance with the embodiment is constructed of a vehicle-mounted apparatus 101 mounted in a service contract vehicle V, and a communication center 102 that is a communication station, for example, managed and run by a service business unit, such as a vehicle manufacture, a motor vehicle retailer, a specialized vendor, etc.

The communication connection between the vehicle-mounted apparatus 101 and the communication center 102 is not limited to a direct connection but may also be a communication connection via vehicle-to-vehicle communication, road-to-vehicle communication, and/or satellite communication.

Figure 1:
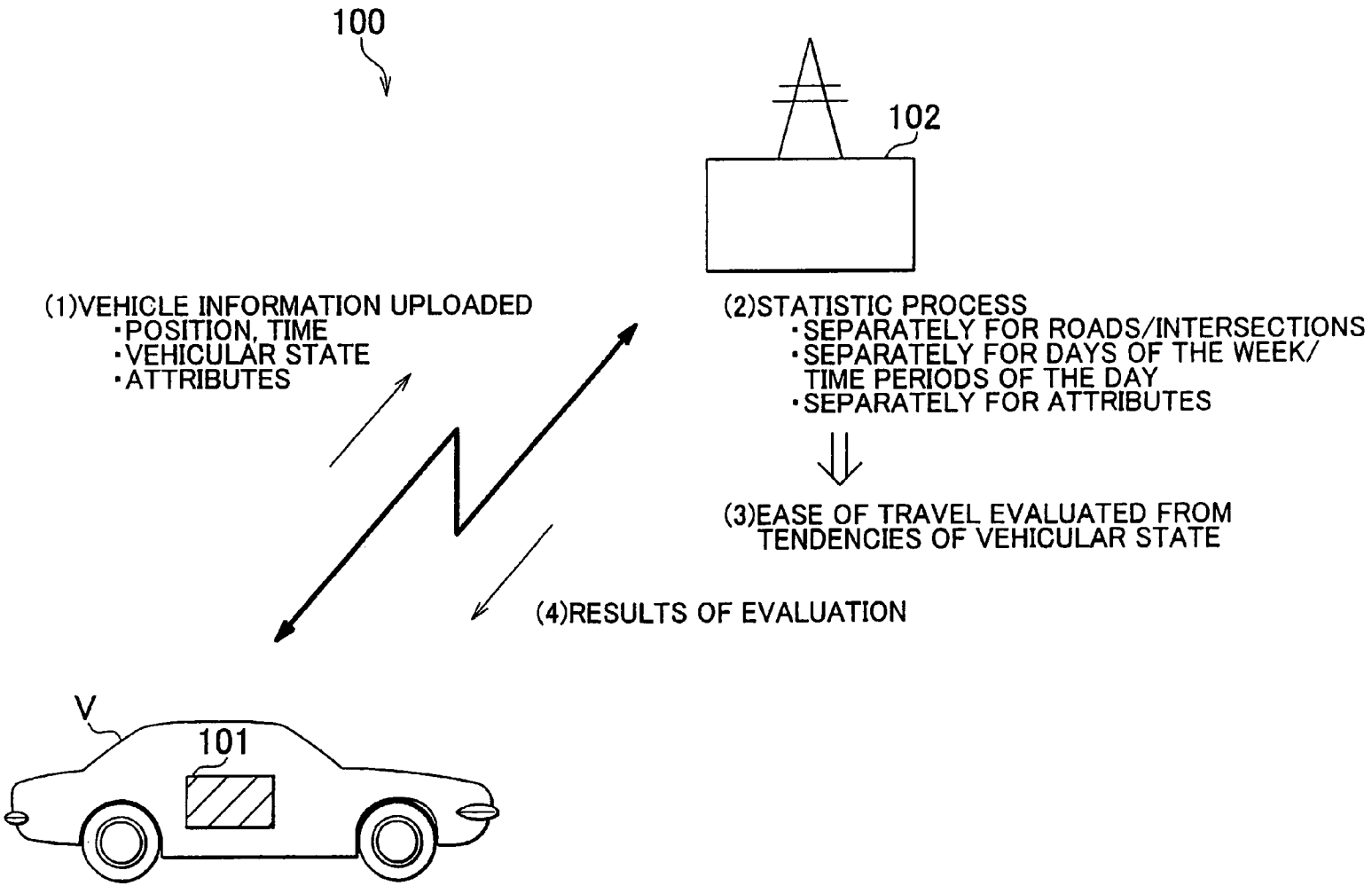
FIG. 1 is a schematic construction diagram of a vehicular drive assist system in accordance with an embodiment of the invention.

Although FIG. 1 shows only one contract vehicle V for the sake of convenience, a plurality of vehicles (users) may join the service provided by the vehicular drive assist system in accordance with the embodiment, and the communication center 102 may be connected for communication with a plurality of contract vehicles V.

The vehicle-mounted apparatus 101 uploads vehicle information, including the present position of the host vehicle V, the vehicular state, and the vehicle's attributes (a small-size vehicle, a large-size vehicle, etc.) as well as vehicle user attributes (elderly or not, driving records, etc.), the present time, etc., for example, in a periodical fashion to the communication center.

The communication center 102, having received a plurality of vehicle information from one or more vehicle-mounted apparatuses 101, statistically processes the acquired vehicular states separately for the individual roads or the individual intersections, and analyzes what vehicular state a vehicle actually having run through a road or an intersection tends to enter during the running through the road or the intersection.

How to evaluate the ease of travel (or the need for attention during the running of the vehicle, which is opposite to the ease of travel) from what tendency parameters indicating vehicular states exhibit will be described in detail below with reference to FIG. 3.

The statistical processing and tendency analysis regarding the vehicular state performed by the communication center 102 may be performed in a more fractionalized fashion.

For example, by using the date and hour or the clock time conveyed from the vehicle-mounted apparatus 101, the communication center 102 can find the tendency of vehicular state on each road and at each intersection dividedly for the tendencies separate for the individual days of the week, the tendencies separate for time periods of the day, etc. Specifically, with respect to each road and intersection, the ease of travel can be evaluated separately for the days of the week and/or for time periods of the day. Concretely, for example, with respect to a specific road, it is possible to obtain a result of evaluation that the road is not easy to travel through during weekday daytime, but the road is easy to travel through during weekday nighttime and during holidays.

Similarly, by using the vehicle attributes and driver's attributes conveyed from the vehicle-mounted apparatus 101, the communication center 102 can find the vehicular state tendency on each road and at each intersection dividedly for the tendencies separate for the individual attributes of vehicles, and tendencies separate for the individual attributes of drivers, etc. That is, with regard to each road and each intersection, the ease of travel can be evaluated separately for the individual attributes of vehicles, and/or separately for the individual attributes of drivers. Concretely, for example, with respect to a specific road, it is possible to obtain a result of evaluation that the road is easy to travel through if the vehicle is a small-size vehicle or if the driver's driving record is relatively long in period, but the road is hard to travel through if the vehicle is a large-size vehicle or if the driver's driving record is relatively short in period.

Furthermore, it is also possible that information that can affect other traffic conditions and the ease of travel of roads, such as information regarding weather, the holding of events, etc., may be acquired, and the vehicular state tendency on each road and at each intersection may be determined dividedly for tendencies separate for the individual weather conditions (clear sky, cloudiness, rain, snow, etc.), different tendencies due to the presence/absence of the holding of an event, etc.

In addition to the processing performed separately for individual roads and intersections, the communication center 102 may also statistically process the vehicular states conveyed from the vehicle-mounted apparatuses 101 separately for individual vehicles (drivers) to evaluate the personality tendencies of the vehicle drivers during driving (impetuous type, easy-going type, etc.), the driving skills of the drivers (good, bad, etc.).

Evaluation results regarding the ease of travel provided by the communication center 102 are sent to the contract vehicles V, for example, by broadcast communication.

The vehicle-mounted apparatus 101 receiving the result of evaluation regarding the ease of travel provided by the communication center 102 performs a route search and a vehicle control on the basis of the result of evaluation. Details thereof will be described later.

Figure 2:
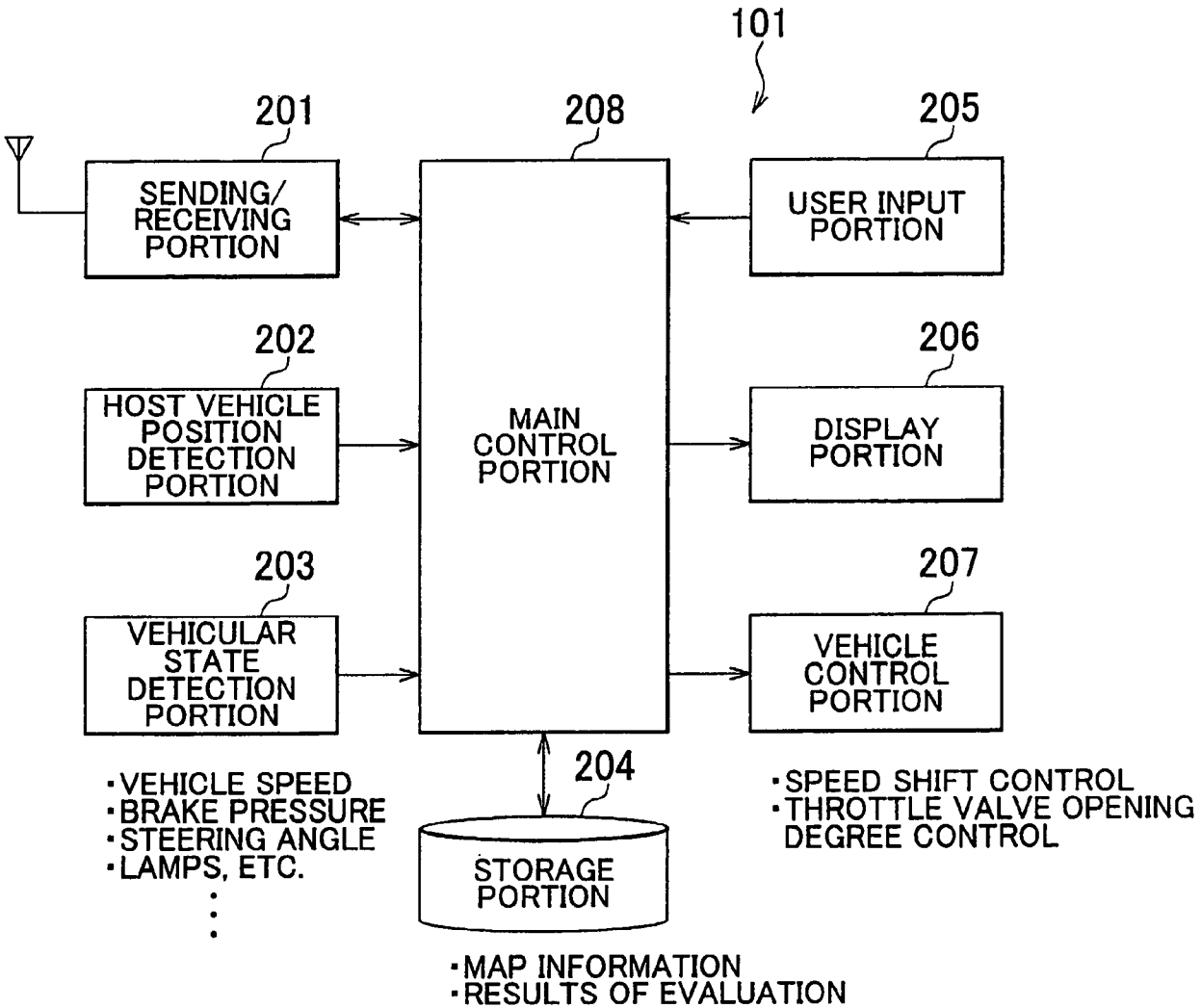
FIG. 2 is a schematic construction diagram of a vehicle-mounted apparatus mounted in a contract vehicle in the vehicular drive assist system in accordance with the embodiment of the invention.

FIG. 2 is a schematic construction diagram of a vehicle-mounted apparatus 101 that is mounted in the contract vehicle V, and that communicates with the communication center 102.

The vehicle-mounted apparatus 101 has a sending/receiving portion 201 for exchanging information with the communication center 102 through the use of wireless communication. The communication method adopted is arbitrary; for example, a cell phone network may be used.

The vehicle-mounted apparatus 101 further has a host vehicle position detection portion 202 that detects the position of the host vehicle, for example, through the use of a GPS (Global Positioning System). As for the detection accuracy (resolution) of the host vehicle position detection portion 202, the higher (finer) is the more preferable. For example, a high-accuracy GPS, such as the RTK-GPS or the like, may be used.

The vehicle-mounted apparatus 101 further has a vehicular state detection portion 203 that detects the vehicular state of the host vehicle. In the embodiment, the vehicular state detected by the vehicular state detection portion 203 refers to the vehicle speed, the brake pressure, the sheering wheel operation angle, the state of lighting/blinking of lights (lamps) and the like.

The vehicle-mounted apparatus 101 further has a storage portion 204 in which map information is stored and retained beforehand and in which results of evaluation in the ease of travel with regard to each road and intersection which are received from the communication center 102 are saved. In the embodiment, the storage portion 204 may be an arbitrary storage medium. The map information stored and retained in the storage portion 204 may be updated to latest data, for example, using communication, when appropriate.

The vehicle-mounted apparatus 101 further has a user input portion 205 for a vehicle user to input arbitrary character lines into the vehicle-mounted apparatus 101 or select and determine a menu item in order to, for example, set a destination for a route search or set a route search condition.

The vehicle-mounted apparatus 101 further has a display portion 206 that visually presents to the user, at least, the host vehicle position detected by the detected by the host vehicle position detection portion 202 which is superimposed on map information stored in the storage portion 204. In the embodiment, the display portion 206 includes, for example, a small-size LCD (liquid crystal display). As an alternative example, the user input portion 205 and the display portion 206 may also be realized as a touch panel display combining the two portions.

The vehicle-mounted apparatus 101 further has a vehicle control portion 207 that carries out predetermined vehicle controls in the vehicle V. In this embodiment, for example, in the case where the vehicle runs through a road or an intersection that has been evaluated as being relatively easy to travel, the vehicle control portion 207 performs an acceleration assist control so as to realize smooth acceleration and reduces the collision alarm/braking intervention level, in comparison with the case where the vehicle runs through a road or an intersection that has been evaluated as being relatively hard to travel. In the former case, the vehicle control portion 207 performs, for example, a speed shift control or a throttle valve opening degree control so that the driver's accelerating operation is assisted. As for the speed shift control, for example, in the case of an automatic stepped transmission, the gear speed is lowered or the shift-up point (speed shift point) is raised so as to facilitate acceleration, and in the case of an automatic stepless transmission, the gear ratio is increased so as to facilitate acceleration. As for the throttle valve opening degree control, for example, the proportion of the throttle opening degree to the accelerator pedal depression amount is increased so as to facilitate acceleration. For example, as for the throttle valve opening degree control performed when the vehicle runs through a road or an intersection that has been evaluated as being relatively hard to travel through, the proportion of the throttle valve opening degree to the accelerator pedal depression amount may be reduced so as to make acceleration harder.

The vehicle-mounted apparatus 101 further has a main control portion 208 that centrally controls various component elements of the vehicle-mounted apparatus 101. The main control portion 208 is, for example, an ECU (Electronic Control Unit, i.e., an electronic control device).

In the embodiment, the main control portion 208 is equipped with a route search function of searching the map information stored in the storage portion 204 for a route from the present host vehicle position detected by the host vehicle position detection portion 202 to a destination set via the user input portion 205, and of presenting a route obtained by the search on the display portion 206.

In addition, if a navigation system is mounted in the vehicle V, the navigation system may include the host vehicle position detection portion 202, the storage portion 204, the user input portion 205, the display portion 206, and the route search function of the main control portion 208.

Furthermore, in the embodiment, the main control portion 208 calculates an average vehicle speed of the host vehicle V from vehicle speeds that the vehicular state detection portion 203 detects, for example, through the use of wheel speed sensors. As an alternative example, the main control portion 208 may compare time-dependent changes in the host vehicle position detected by the host vehicle position detection portion 202 with map information stored in the storage portion 204, and may find an average vehicle speed of the host vehicle V from the moving distance on the map data. In this case, the vehicular state detection portion 203 does not need to have a vehicle speed detection function.

Next, which road or intersection to evaluate for ease of travel and how to evaluate the ease of travel thereof from the vehicular state tendencies revealed by the statistic processing of the communication center 12 will be described with reference to FIG. 3. FIG. 3 is a diagram showing relationships between actual tendencies of vehicular state and results of the ease-of-travel evaluation separately for parameters that indicate vehicular states. Examples of the vehicular state parameters that can be affected to the ease of travel (or the need for attention in running the road) include braking frequency, brake pressure change, average vehicle speed, course change (or the number of times of operating the winker), steering wheel operation speed, the number of times of operating the steering wheel, the number of times of using the fog lamp, etc.

In the embodiment, the communication center 102 evaluates stronger tendencies toward relatively low brake pedal operation frequency as being easier to travel through, and evaluates stronger tendencies toward relatively high brake pedal operation frequency as being harder to travel through or there being higher need for attention (e.g., by judging that there exists a cause of such tendencies, for example, many occurrences of a pedestrian running into the road, many intersections with no traffic signals, etc.).

Furthermore, in the embodiment, the communication center 102 evaluates stronger tendencies toward relatively small or less frequent brake pressure changes as being easier to travel through, and evaluates stronger tendencies toward relatively great or frequent brake pressure changes as being harder to travel through or there being higher need for attention (e.g., by judging that there exists a cause of such tendencies, for example, an intersection with a blocked view, a large number of times of applying rapid braking, etc.).

Furthermore, in the embodiment, the communication center 102 evaluates stronger tendencies toward relatively high average vehicle speeds as being easier to travel through, and evaluates stronger tendencies toward relatively low average vehicle speeds as being harder to travel through (e.g., by judging that there exists a cause of such tendencies, for example, many stops and goes, that is, many repetitions of temporary stops and restarts, etc.).

Furthermore, in the embodiment, the communication center 102 evaluates stronger tendencies toward relatively small numbers of times of operating the winker as being easier to travel through, and evaluates stronger tendencies toward relatively large numbers of times of operating the winker as being harder to travel through (e.g., by judging that there exists a cause of such tendencies, for example, many on-street parked vehicles, many vehicles waiting to turn right, etc.).

Furthermore, in the embodiment, the communication center 102 evaluates stronger tendencies toward relatively slow steering wheel operation speeds as being easier to travel through, and evaluates stronger tendencies toward relatively quick steering wheel operation speeds as being harder to travel through (e.g., by judging that there exists a cause of such tendencies, for example, a blocked view at an intersection, etc).

Furthermore, in the embodiment, the communication center 102 evaluates stronger tendencies toward relatively small numbers of times of operating the steering wheel as being easier to travel through, and evaluates stronger tendencies toward relatively large numbers of times of operating the steering wheel as being harder to travel through (e.g., by judging that there exists a cause of such tendencies, for example, a serpentine road, etc.).

Furthermore, in the embodiment, the communication center 102 evaluates stronger tendencies toward relatively small numbers of times of using the fog lamp as being easier to travel through, and evaluates stronger tendencies toward relatively large numbers of times of using the fog lamp as being harder to travel through (e.g., by judging that there exists a cause of such tendencies, for example, an area where fog frequently occurs, etc.).

Figure 4:
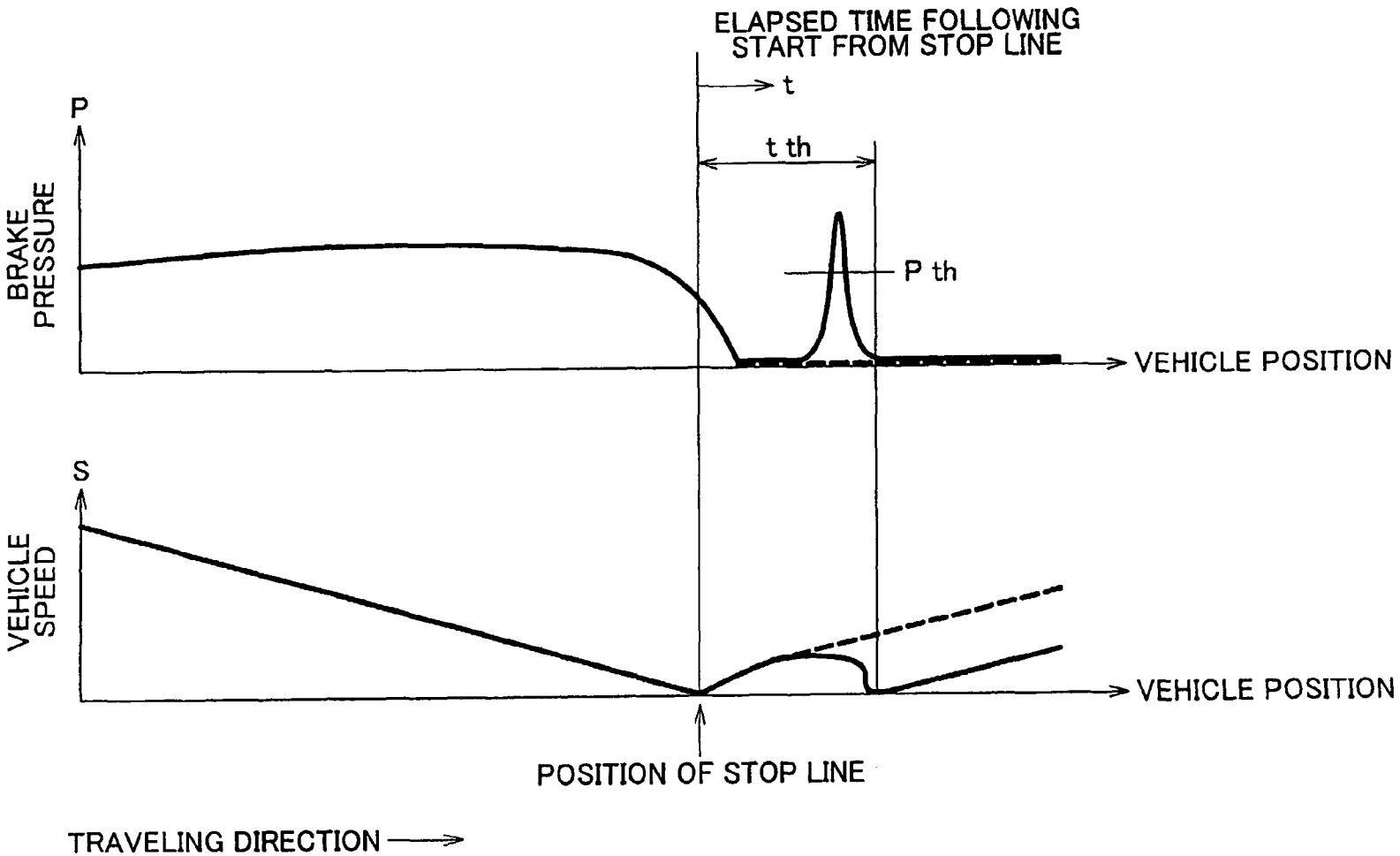
FIG. 4 is a graph indicating an example of a rapid braking occurrence determination operation in the vehicular drive assist system in accordance with the embodiment of the invention.
Figure 5:
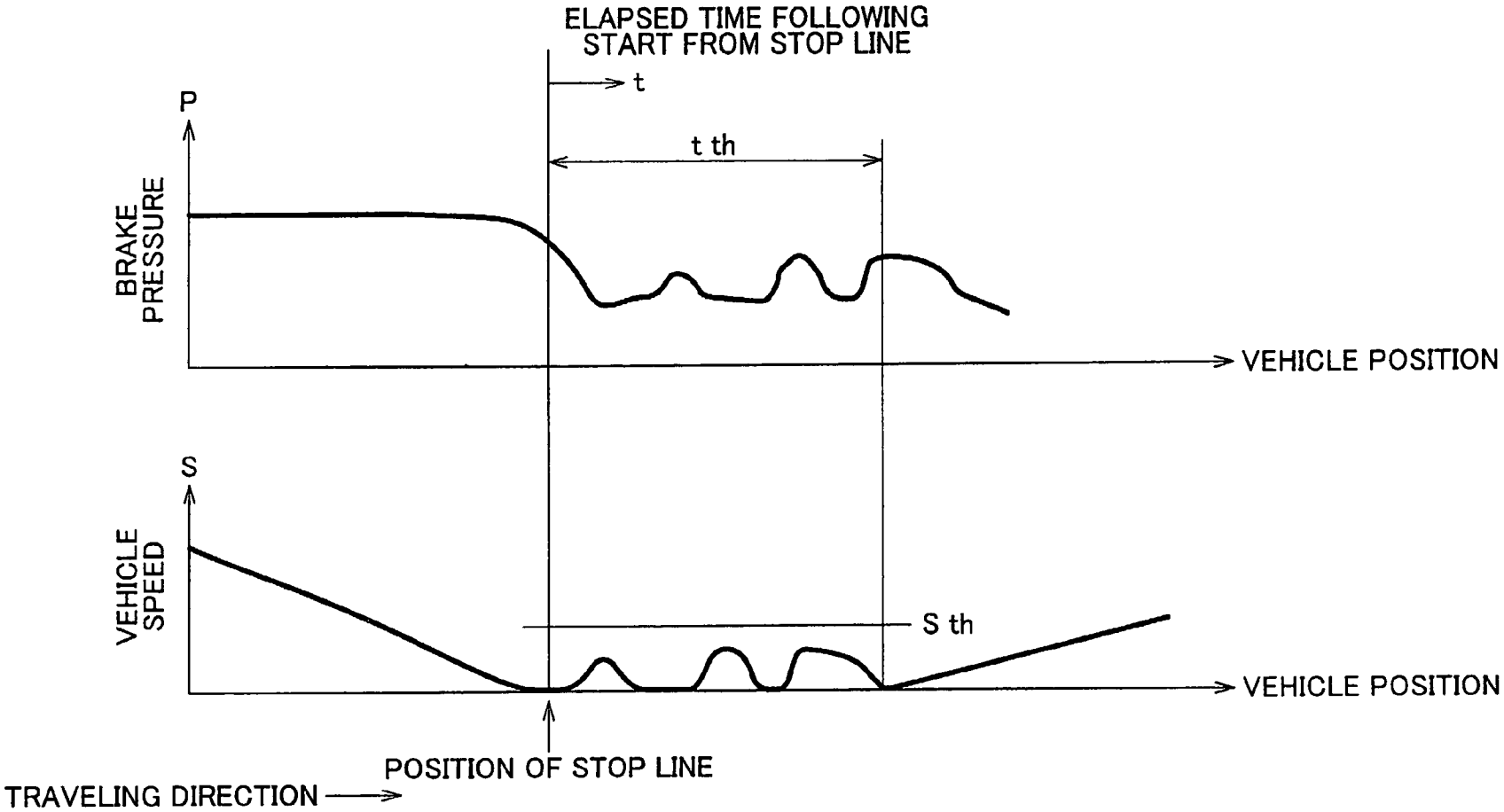
FIG. 5 is a graph indicating an example of a gentle acceleration/deceleration occurrence determination operation in the vehicular drive assist system in accordance with the embodiment of the invention.

An example of a technique of determining an intersection with a tendency toward a less clear view and/or many occurrences of a pedestrian running into the road and therefore with high need for attention in this embodiment will be described with reference to FIGS. 4 and 5. FIGS. 4 and 5 show changes in the brake pressure P and the vehicle speed S in the case where the vehicle V approaches an intersection, and temporarily stops at a stop line in front of the intersection, and restarts to travel through the intersection or turn right or left.

In the graph of FIG. 4, solid lines indicate changes in the brake pressure P and the vehicle speed S in the case where, immediately after the vehicle restarts from the stop line, the braking pedal is rapidly depressed due to, for example, a pedestrian running into the road, or the like, and broken lines indicate changes in the brake pressure P and the vehicle speed S in the case where the vehicle smoothly restarts and accelerates without rapid braking.

In this embodiment, if there is a tendency for many vehicles stopping at the stop line in front of an intersection to be rapidly braked immediately after restarting, the intersection is evaluated as an intersection that has a blocked view and/or many occurrences of a pedestrian running into the road, and therefore has high need for attention (or, is hard to travel through).

In this embodiment, an elapsed time t following the restart from a stop line is provided as shown in FIG. 4. If while the elapsed time t is less than or equal to a predetermined tth, a brake pressure P exceeding a predetermined pressure Pth is detected, then it is judged that rapid braking is applied immediately after the restart from the stop line.

The graphs in FIG. 5 indicate changes in the brake pressure P and the vehicle speed S in the case where a restart from a stop line is followed by repeated accelerations and decelerations to go slow and see.

In this embodiment, if there is a tendency for many vehicles stopping at the stop line in front of an intersection to be gently accelerated and decelerated immediately after restarting, the intersection is evaluated as an intersection that has a blocked view and/or many occurrences of a pedestrian running into the road, and therefore has high need for attention (or, is hard to travel through).

In this embodiment, an elapsed time t following the restart from a stop line is provided as shown in FIG. 5. If while the elapsed time t is less than or equal to a predetermined tth, stops and accelerations of the vehicle are repeatedly performed a predetermined number of times without any peak vehicle speed exceeding a predetermined vehicle speed Sth (e.g., a maximum creep speed), it is judged that rapid braking is applied immediately after the restart from the stop line.

Figure 6:
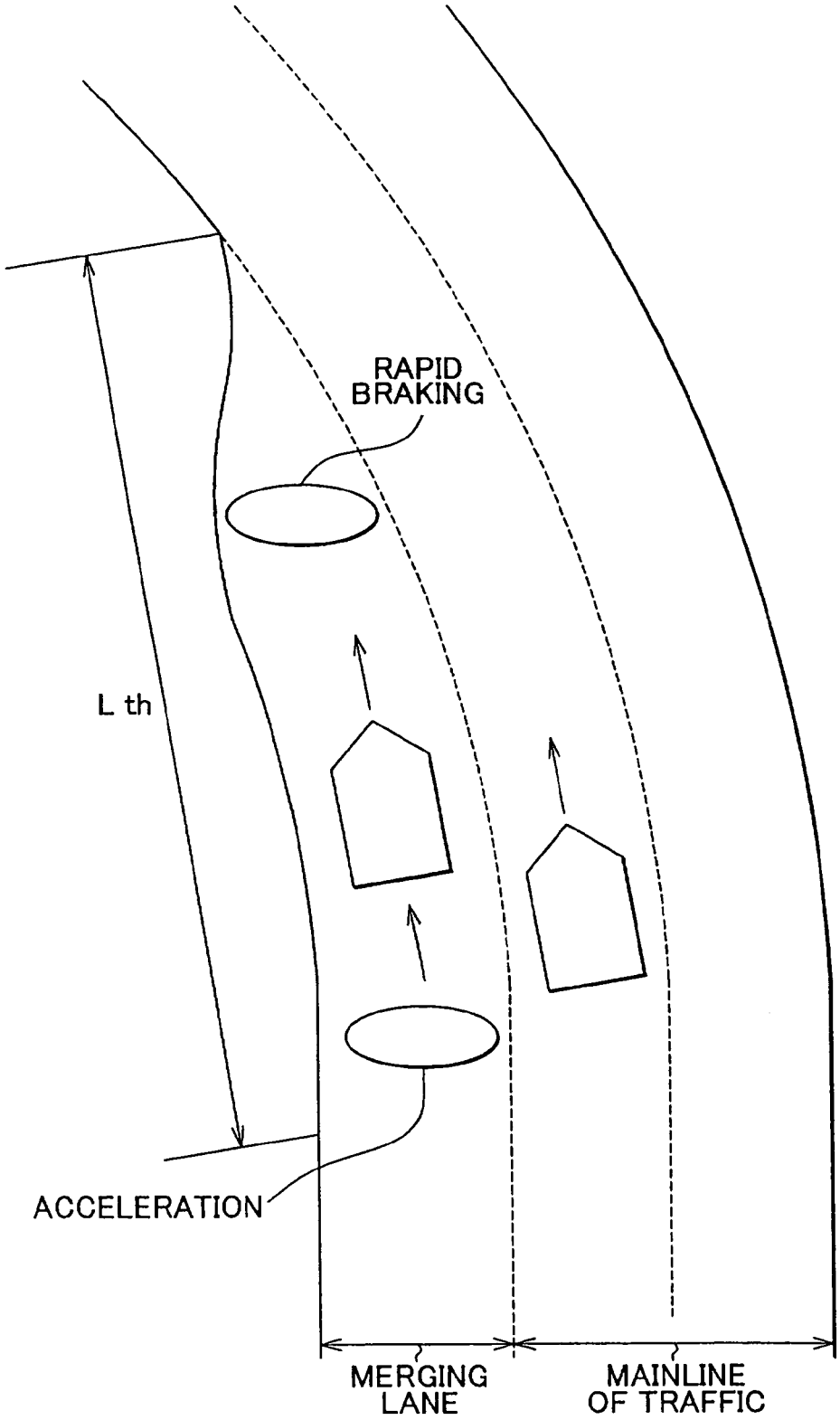
FIG. 6 is a diagram for describing a mergence difficulty determination operation by the vehicular drive assist system in accordance with the embodiment of the invention.

An example of a technique of determining, in this embodiment, a merging lane of an express highway, a motor vehicle-dedicated road, etc., which has a tendency toward a difficult merge into the mainline of traffic will be described with reference to FIG. 6.

If in a merging lane, there is a tendency for many vehicles having accelerated for merging into the mainline to be rapidly decelerated before merging, the merging point is evaluated as a merging point that has high difficulty in mergence and therefore is hard to travel through.

In this embodiment, if within a predetermined section Lth, an acceleration greater than or equal to a predetermined value is detected and then a brake pressure greater than or equal to a predetermined value is detected, it is judged that merging is accomplished at a close timing due to high difficulty in mergence.

Thus, the communication center 102 evaluates and estimates the ease of travel and the need for attention from the tendencies of the vehicular state as mentioned above, with respect to the individual roads or the individual intersections, and furthermore, with respect to each road or intersection separately for individual days of the week and individual time periods of the day. Then, results of the evaluation are sent to the contract vehicles V.

The sending of evaluation results may be carried out by, for example, broadcast sending. Or, specific evaluation results may be sent to specific vehicles V (vehicle-mounted apparatus 101) by multicast sending. If evaluation results are based on a vehicular state tendency obtained by the statistic processing performed separately for the attributes of vehicles or the attributes of drivers (e.g., evaluation results such as a road not easy for a large-size vehicle to travel through, or an intersection where an elderly driver particularly needs to pay attention, etc.), it is preferable that evaluation results be sent by multicast sending only to targeted vehicle-mounted apparatuses 101 that have corresponding vehicle attributes or driver attributes.

Thus, the vehicle-mounted apparatus 101 is able to recognize actual road circumstances that cannot be obtained from ordinary map information (e.g., recognize that the intersection A has a blocked view and has high likelihood of a pedestrian running into the road, or the road B usually has many on-street parked vehicles, and therefore is hard to travel through, etc.).

In this embodiment, the vehicle-mounted apparatus 101 uses the evaluation results acquired from the communication center 102 for A) route search, and B) vehicle control.

If evaluation results are used for A) the route search, the vehicle-mounted apparatus 101 prompts, beforehand, the vehicle driver to select, via the user input portion 205, an initial setting as to whether the route search is to be performed so as to find a route that preferentially contains roads and intersections evaluated as being relatively easy to travel through or being relatively low in the need for attention, or so as to find a route that is estimated to take the shortest time to the destination regardless of the evaluation results.

Even in the latter case with time priority, the roads and the intersections whose need for attention is greater than or equal to a predetermined level may be unconditionally excluded from the route search.

Moreover, through the use of vehicle attributes- and driver attributes, the setting may be made such that a) a route that is easy and safe to travel through is preferentially selected for guidance, in the case of an elderly driver or a driver with a short history of driving, b) ordinary roads, instead of express highways, bypass roads and the like, are preferentially selected for guidance, in the case of a vehicle that is not good at high-speed running, such as a vehicle with small engine displacement, or c) a route that excludes narrow roads is selected for guidance, in the case of a vehicle with a large width.

In any of the cases, it is preferable that the contents set or selected by the driver be learned and used for an optimal route guidance later on.

Figure 7:
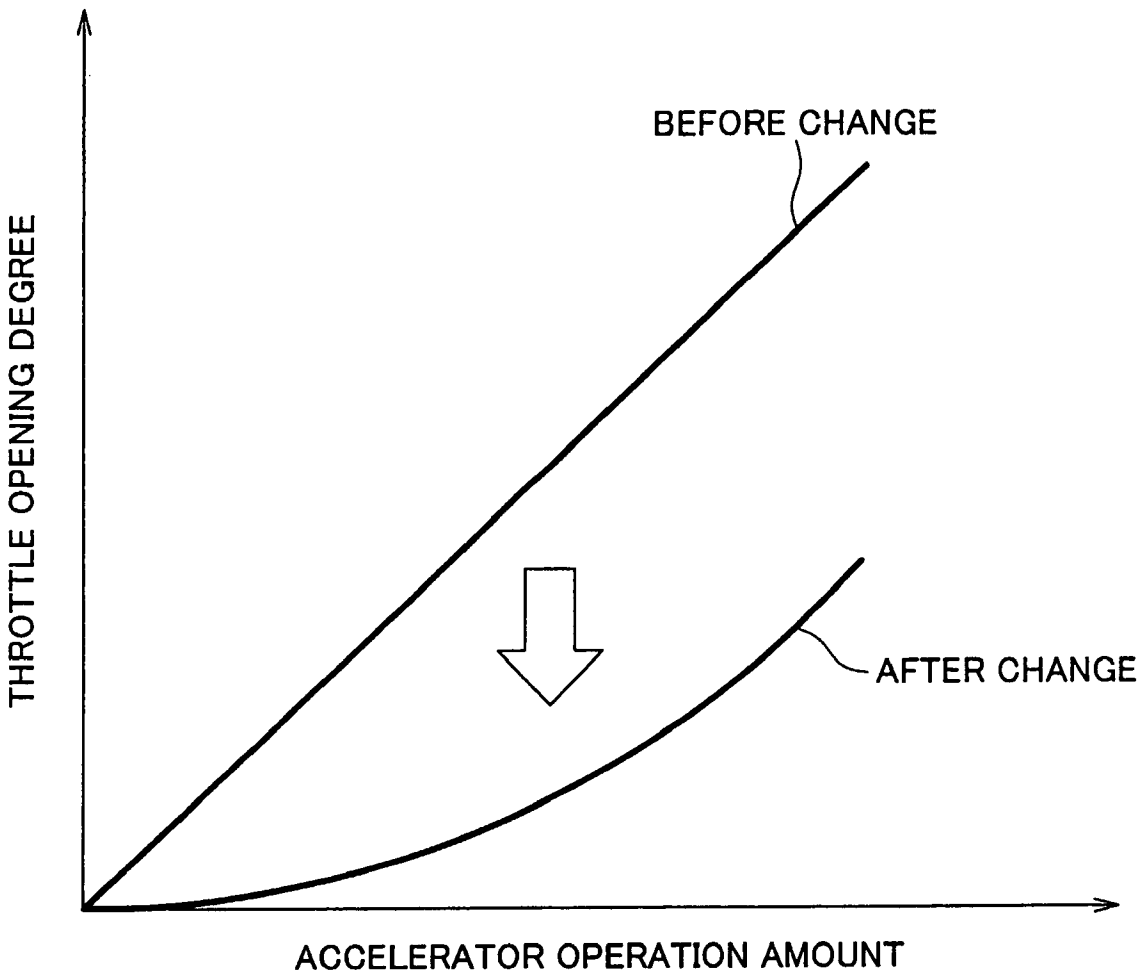
FIG. 7 is a diagram showing an example of contents of a throttle valve opening degree control by the vehicular drive assist system in accordance with the embodiment of the invention.

If evaluation results are used for B) the vehicle control, the vehicle-mounted apparatus 101, using the vehicle control portion 207, for example, B-1) performs the acceleration assist control as described above on a road evaluated as being easy to travel through, or B-2) reduces the collision alarm level and the braking intervention level on a road or at an intersection which has been evaluated as being hard to travel through (i.e., an alarm is output or a braking intervention is performed at a stage that is earlier than usual). Or, the vehicle-mounted apparatus 101 may also B-2') make it less easy to accelerate the vehicle by changing the content of the throttle valve opening degree control so that the proportion of the throttle valve opening degree to the accelerator pedal depression amount becomes smaller than usual as shown in FIG. 7, when a road or an intersection evaluated as being hard to travel through is traveled through. This is effective particularly if the driver is an elderly driver or a driver with a short driving record and therefore it is considered that there is a likelihood of the driver being unable to perform appropriate accelerator control. In this case, the brake oil pressure may be set relatively higher than usual so as to improve the brake responsiveness.

Besides, the vehicle-mounted apparatus 101 B-3) calls for attention of the driver prior to the entrance into an intersection evaluated as being high in the need for attention. This attention calling is performed by, for example, causing the display portion 206 to display character lines and/or graphics for calling attention, and/or outputting a voice message that means to call attention from a speaker (not shown).

Furthermore, the vehicle-mounted apparatus 101 may also B-4) prohibits operation of the control of assisting the manipulation of the host vehicle on a road evaluated as being relatively hard to travel through or being high in the need for attention if the vehicle is equipped with a system that assists the manipulation of the vehicle during traffic congestion.

On the other hand, for example, if the communication center 102 is in coordination with a traffic control system that controls the flow of vehicle traffic in a predetermined area through the use of an infrastructure facility such as traffic signals and the like, it is also possible that evaluation results may be provided for the system, and the traffic control system may perform control such that flows of vehicle traffic are led to the roads and intersections that have been evaluated as being relatively easy to travel through or as being low in the need for attention.

Thus, according to the embodiment, the communication center 102 is able to efficiently and accurately estimate actual road circumstances that cannot be recognized from typical map information, for example, a clear or not clear view at the intersection, the usual number of on-street parked vehicles, etc., through the statistic processing of information regarding the vehicular state collected widely from various vehicles that actually travel through the roads and intersections.

Besides, according to the embodiment, the contract vehicles upload their own positions and their vehicular states to the communication center 102, and therefore can acquire results of evaluation regarding the ease of travel of roads and intersections estimated from results of the statistic processing performed in the communication center 102. Thus, the load of processing on each vehicle is favorably small. In other words, each vehicle does not need to perform processing, such as the statistic processing of data of the other vehicles, the estimation of ease of travel from collected data, etc. This is similar to a relationship of a questionnaire survey in which if a person cooperates with the survey as a respondent, the person gets totaled results from the survey organizer.

Besides, according to the embodiment, by uploading the date and hour, the clock time, the vehicle attributes, the driver attributes, etc. from each vehicle to the communication center 102, the statistic process performed at the communication center 102 can be made more detailed. Therefore, the ease of travel of roads and intersections can be more finely evaluated.

Furthermore, according to the embodiment, since each vehicle can acquire the actual ease of travel/need for attention regarding various roads and intersections from the communication center 102, the route search and the vehicle control in each vehicle can be performed precisely with the actual road circumstances.

The invention is applicable to a vehicular drive assist system that evaluates ease of travel of roads, and assists the driving operation of the vehicle on the basis of results of the evaluation. The external appearance, the weight, the size, the running performance, etc., of a subject vehicle are not concerned.

The invention claimed is:

1. A vehicular drive assist system that analyzes information collected from more than one vehicle and sends a result of analysis to at least one vehicle, comprising:

a vehicle-mounted apparatus mounted in each of the more than one vehicle including a host vehicle; and a communication center that communicates with the vehicle-mounted apparatus, wherein the vehicle-mounted apparatus:

detects a present position of the host vehicle;

detects a vehicular state of the host vehicle; and sends the present position and the vehicular state at the present position detected to the communication center; and wherein the communication center:

performs statistic processing of the vehicular state received, separately for each predetermined area on a road, by using the present position;

calculates a tendency of the vehicular state separately for each predetermined area;

evaluates whether there is a high need for attention on the road in the predetermined area from the tendency calculated; and sends a result of evaluation to at least one vehicle.

2. The vehicular drive assist system according to claim 1, wherein the predetermined area is set as a region that is a predetermined distance before an intersection.

3. The vehicular drive assist system according to claim 1, wherein:

the vehicular state is a frequency of brake pedal operation; and the communication center evaluates the predetermined area having a tendency toward a relatively low frequency of brake pedal operation as being easier to travel through than an area having a tendency toward a relatively high frequency of brake pedal operation.

4. The vehicular drive assist system according to claim 1, wherein:

the vehicular state is a brake pressure change; and the communication center evaluates the predetermined area having a tendency toward a relatively less brake pressure change as being easier to travel through than an area having a tendency toward a relatively more brake pressure change.

5. The vehicular drive assist system according to claim 1, wherein:

the vehicular state is an average vehicle speed; and the communication center evaluates the predetermined area having a tendency toward a relatively high average vehicle speed as being easier to travel through than an area having a tendency toward a relatively low average vehicle speed.

6. The vehicular drive assist system according to claim 1, wherein:

the vehicular state is a number of times of operating a winker; and the communication center evaluates the predetermined area having a tendency toward a relatively small number of times of operating the winker as being easier to travel through than an area having a tendency toward a relatively large number of times of operating the winker.

7. The vehicular drive assist system according to claim 1, wherein:

the vehicular state is a steering wheel operation speed; and the communication center evaluates the predetermined area having a tendency toward a relatively slow steering wheel operation speed as being easier to travel through than an area having a tendency toward a relatively quick steering wheel operation speed.

8. The vehicular drive assist system according to claim 1, wherein:

the vehicular state is a number of times of operating a steering wheel; and the communication center evaluates the predetermined area having a tendency toward a relatively small number of times of operating the steering wheel as being easier to travel through than an area having a tendency toward a relatively large number of time of operating the steering wheel.

9. The vehicular drive assist system according to claim 1, wherein:

the vehicular state is a vehicular speed change;

the predetermined area is a region within a predetermined range past a stop line; and the communication center evaluates the predetermined area having a tendency toward a relatively high frequency of stops and accelerations being repeated a predetermined number of times within a predetermined time as being harder to travel through than an area having a tendency toward a relatively low frequency of stops and accelerations being repeated the predetermined number of times within the predetermined time.

10. The vehicular drive assist system according to claim 1, wherein:

the vehicular state is a vehicular speed change;

the predetermined area is a merging lane; and the communication center evaluates the predetermined area having a tendency toward a relatively high frequency of rapid acceleration and rapid deceleration being performed as being harder to travel through than an area having a tendency toward a relatively low frequency of rapid acceleration and rapid deceleration being performed.

11. The vehicular drive assist system according to claim 1, wherein the vehicle having received the result of evaluation uses the result of evaluation for route search.

12. The vehicular drive assist system according to claim 1, wherein if a user selects an ease-of-travel priority route search, the vehicle having received the result of evaluation searches for a route that preferentially goes through the predetermined area evaluated as being relatively easy to travel through from the result of evaluation, and that if the user selects a time priority route search, the vehicle searches for a route that preferentially goes through the predetermined area evaluated as being relatively hard to travel through from the result of evaluation.

13. The vehicular drive assist system according to claim 1, wherein the vehicle having received the result of evaluation uses the result of evaluation for a predetermined vehicle control.

14. The vehicular drive assist system according to claim 13, wherein the vehicle having received the result of evaluation calls for attention of the vehicle driver in front of the predetermined area evaluated as being relatively hard to travel through from the result of evaluation.

15. The vehicular drive assist system according to claim 1, wherein:

the vehicle-mounted apparatus sends a vehicle attribute of the vehicle and a vehicle user attribute of the vehicle to the communication center; and the communication center calculates the tendency of the vehicular state in the predetermined area by using the vehicle attribute and the vehicle user attribute of the vehicle received.

16. The vehicular drive assist system according to claim 15, wherein the communication center sends the result of evaluation to the at least one vehicle that has a vehicle attribute and a vehicle user attribute that are the same as the vehicle attribute and the vehicle user attribute of the vehicle.

17. A vehicular drive assist method, comprising:

receiving, from more than one vehicle, a vehicular state and a present position of at least one vehicle;

performing statistic processing of the vehicular state received, separately for each predetermined area on a road, by using the present position of the vehicle;

calculating a tendency of the vehicular state separately for each predetermined area;

evaluating whether there is a high need for attention on the road in the predetermined area from the tendency calculated; and sending a result of evaluation to at least one vehicle.

18. A vehicle-mounted apparatus, comprising:

a sending/receiving portion that sends a vehicular state to a non-vehicular mounted communication center and that receives from the communication center a result of evaluation that indicates whether there is a high need for attention on a road in a predetermined area;

a host vehicle position detection portion that detects a present position of a host vehicle;

a vehicular state detection portion that detects a vehicular state of the host vehicle;

a storage portion that stores and retains map information and the result of evaluation;

a vehicle control portion that carries out a vehicle control of the host vehicle; and a main control portion that controls the sending/receiving portion so that the present position of the host vehicle detected by the host vehicle position detection portion and the vehicular state of the host vehicle detected by the vehicular state detection portion are sent to the communication center, and controls the storage portion so that the result of evaluation received from the communication center is stored and retained, and controls the vehicle control portion so that the vehicle control of the host vehicle is carried out based on the result of evaluation stored and retained in the storage portion.

19. The vehicle-mounted apparatus according to claim 18, further comprising:

a user input portion that receives an input from a user; and a display portion that displays information from the storage portion, wherein the main control portion searches the map information stored in the storage portion for a route from the present position of the host vehicle detected by the host vehicle position detection portion to a destination set via the user input portion based on the result of evaluation received from the communication center, and presents the route obtained by search on the display portion.

20. The vehicle-mounted apparatus according to claim 18, wherein the main control portion controls the vehicle control portion so that if the road in the predetermined area is evaluated as being harder to travel through based on the result of evaluation stored in the storage portion, a proportion of a throttle valve opening degree to a depression amount of an accelerator pedal of the vehicle is made smaller.

21. The vehicle-mounted apparatus according to claim 18, wherein the main control portion controls the vehicle control portion so that if the road in the predetermined area is evaluated as being easier to travel through based on the result of evaluation stored in the storage portion, a speed change ratio of a transmission of the vehicle is made larger.

* * * * *